US005845792A

United States Patent [19]

Hsu

[11] Patent Number: 5,845,792

[45] Date of Patent: Dec. 8, 1998

[54] SUPPORT DEVICE FOR KEYS

[76] Inventor: Chin-Lien Huang Hsu, No. 38, Lane 152, Min Sheng Road, Taichung, Taiwan

[21] Appl. No.: 825,520

[22] Filed: Mar. 31, 1997

[51] Int. Cl.[6] ..... A47F 7/00

[52] U.S. Cl. ..... 211/85.9; 40/657; 211/10; 211/87.01

[58] Field of Search ..... 211/85.9, 10, 94.01, 211/87.01; 40/634, 657, 649

[56] References Cited

U.S. PATENT DOCUMENTS

| | | | |
|---|---|---|---|
| 2,371,433 | 3/1945 | Davis | 211/94.01 X |
| 2,451,110 | 10/1948 | Newman | 211/94.01 |
| 3,070,235 | 12/1962 | Manzardo | 40/657 X |
| 4,334,620 | 6/1982 | Block | 211/85.9 |
| 4,401,222 | 8/1983 | Kulikowski et al. | 211/94.01 |
| 4,771,897 | 9/1988 | Ho | 211/85.9 |

*Primary Examiner*—Robert W. Gibson, Jr.
*Attorney, Agent, or Firm*—Charles E. Baxley, Esq.

[57] ABSTRACT

A support device includes a frame having a number of hooks for engaging with keys and having a channel and having a number of openings and having a number of fins arranged corresponding to the openings for allowing the fins to be secured to a support wall member. A panel is engaged in the channel of the frame for making notes to the keys and for allowing the keys to be easily found. The frame includes a number of slots formed in the bottom portion and arranged corresponding to the openings and the fins for allowing the frame to be easily secured to the projections of the support wall member.

2 Claims, 2 Drawing Sheets

SUPPORT DEVICE FOR KEYS

BACKGROUND OF THE INVENTION

1. Field of the Invention

The present invention relates to a support device, and more particularly to a support device for keys.

2. Description of the Prior Art

Typical keys are secured together by a ring member such that the required keys may not be easily found. In order to solve the problem, a plate is provided and has a number of hooks for supporting the keys. However, the plate may not be easily secured onto a support wall, and the keys also may not be easily found.

The present invention has arisen to mitigate and/or obviate the afore-described disadvantages of the conventional key supports.

SUMMARY OF THE INVENTION

The primary objective of the present invention is to provide a support device which may suitably support and store keys.

In accordance with one aspect of the invention, there is provided a support device for keys comprising a frame body including a lower portion having a plurality of hooks for engaging with the keys, the frame body including a channel and including a plurality of openings and including a plurality of fins arranged corresponding to the openings for allowing the fins to be secured to a support wall member, and a panel engaged in the channel of the frame body for making notes to the keys and for allowing the keys to be easily found.

The frame includes a number of slots formed in the bottom portion and arranged corresponding to the openings and the fins for allowing the frame to be easily secured to the projections of the support wall member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
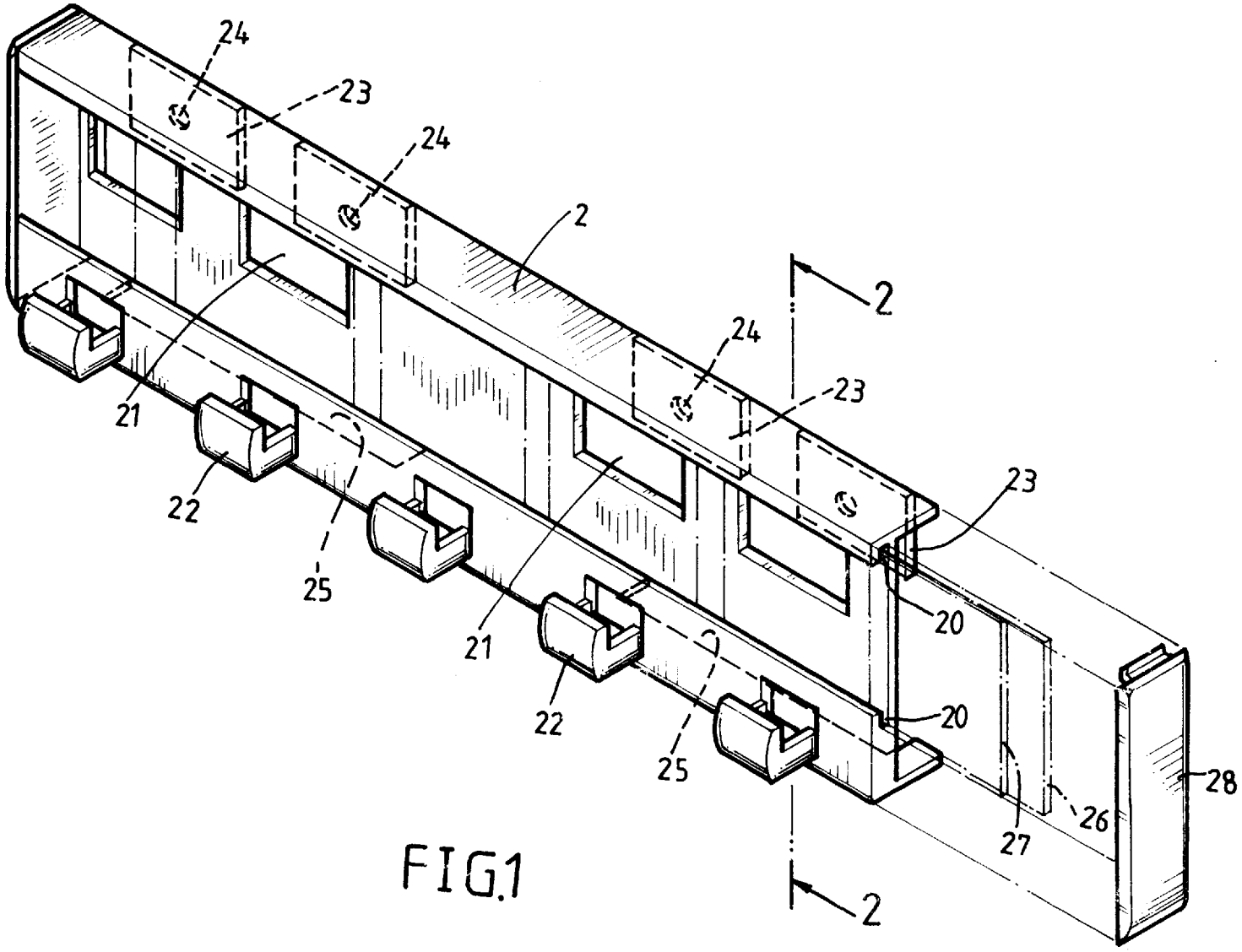
FIG. 1 is a perspective view of a support device in accordance with the present invention.
Figure 2:
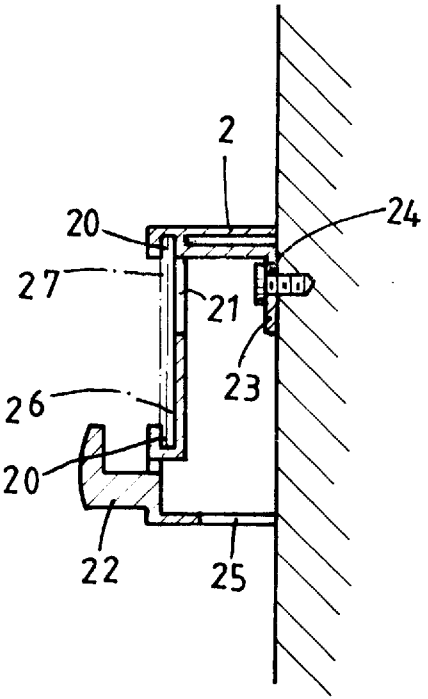
FIG. 2 is a cross sectional view taken along lines 2—2 of FIG. 1.

Referring to the drawings, and initially to FIGS. 1 and 2, a support device in accordance with the present invention comprises a frame body 2 including a lower portion having a number of hooks 22 extended forward for hooking keys. The frame body 2 includes a channel 20 for engaging with a panel 26 and a protective film or membrane 27. The panel 26 may make notes for the keys supported on the hooks 22. The film or membrane 27 may be used for protecting the panel 26. The frame body 2 includes a number of openings 21 and a number of fins 23 arranged corresponding to the openings 21. The fins 23 each includes a hole 24 for engaging with fastener member (FIG. 2). The openings 21 allow the fasteners to be easily driven by driving tools (FIG. 2). One or two caps 28 are secured to the side portions of the frame body 2 for securing the panel 26 and the film 27 in place.

Figure 3:
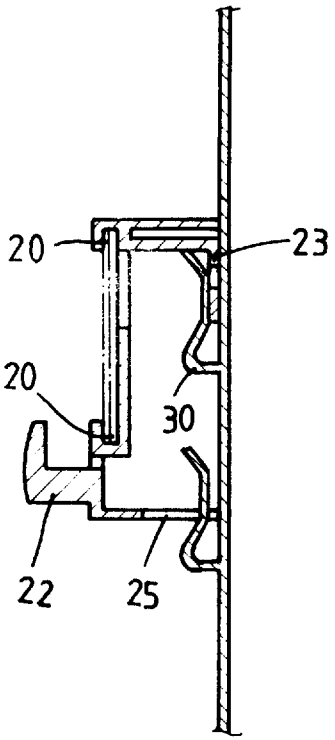
FIG. 3 is a cross sectional view similar to FIG. 2, illustrating an application of the support device.

As shown in FIGS. 1 and 3, the frame body 2 includes a number of slots 25 formed in the bottom portion and arranged corresponding to the openings 21 and the fins 23 for allowing the fins 23 to engage with projections 30 provided on the supporting wall and for allowing the frame body 2 to be easily secured to the supporting wall.

Accordingly, the support device in accordance with the present invention includes a configuration for allowing the support device to be easily and quickly secured onto a support wall member. The panel 26 may be used for making note which allows the keys to be easily found.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A device for supporting keys, said device comprising:

a frame body including:

a) a plurality of openings, b) a lower portion having a plurality of hooks extended forward for engaging with and for supporting the keys, c) a front portion having a channel, and d) a rear portion having a plurality of fins located behind said openings, a panel engaged in said channel of said frame body for shielding said openings of said frame body, and a plurality of fasteners engaged with said fins of said frame body for securing said frame body to a supporting wall, said fasteners being allowed to engage with said fins before said panel is engaged into said channel for covering said openings.

2. The supporting device according to claim 1, wherein said frame body includes a plurality of slots formed in said lower portion and located below said fins respectively.

* * * * *